United States Patent [19]

Orii

[11] Patent Number: 4,487,409

[45] Date of Patent: Dec. 11, 1984

[54] APPARATUS FOR AUTOMATIC FEEDING OF WORKPIECE

[75] Inventor: Masaru Orii, Machida, Japan

[73] Assignee: Kabushiki Kaisha Orii Jidoki Seisakusho, Japan

[21] Appl. No.: 403,358

[22] Filed: Jul. 30, 1982

[30] Foreign Application Priority Data

Oct. 27, 1981 [JP] Japan ..... 56-171864

[51] Int. Cl.[3] ..... B65H 5/08

[52] U.S. Cl. ..... 271/267; 198/339; 271/11; 271/14; 271/107; 271/139; 414/121; 414/752

[58] Field of Search ..... 271/107, 11, 14, 139, 271/267, 268, 194; 74/53; 414/749, 752, 121; 198/339

[56] References Cited

U.S. PATENT DOCUMENTS

| | | | |
|---|---|---|---|
| 3,179,262 | 4/1965 | Carlson, Sr. et al. | 414/752 |
| 3,751,996 | 8/1973 | Beezer | 74/53 |
| 3,998,452 | 12/1976 | Grieshaber | 271/139 X |
| 4,280,786 | 7/1981 | Dyche | 414/749 |
| 4,361,413 | 11/1982 | Toda | 414/752 |

*Primary Examiner*—Bruce H. Stoner, Jr.
*Assistant Examiner*—John A. Carroll
*Attorney, Agent, or Firm*—Jordan B. Bierman

[57] ABSTRACT

An automatic feeding apparatus is disclosed which includes an arm having at one end a hand for holding a workpiece and which is pivotally mounted at the other end in a vertically movable manner, a swinging member that is swung by a swinging mechanism driven by a single motor and which is swung to move the other end of the arm vertically, and a guide member that is shifted along a guide groove in conjunction with the swinging motion of the swinging member to control the movement of the one end of the arm holding the workpiece. The guide groove consists of a curved area that controls a horizontal movement of the one end of the arm and straight areas that control the vertical movements of the one end of the arm at each extremity of the horizontal movement. The swinging action of the swinging member causes the hand to move horizontally between the feed position and working position of the workpiece and to move vertically by a predetermined distance at each position.

4 Claims, 5 Drawing Figures

APPARATUS FOR AUTOMATIC FEEDING OF WORKPIECE

FIELD OF THE INVENTION

The present invention relates to an apparatus for automatically feeding a workpiece, and more particularly, to a simple automatic feed apparatus that uses a single power source to drive a swinging mechanism and guide means for first lifting the workpiece in a feed position, then carrying it horizontally and lowering it in a working position.

BACKGROUND OF THE INVENTION

Various apparatuses are known for feeding a workpiece automatically to machine tools such as presses, and in every type of such apparatus, the hand holding the workpiece must always be moved along the same path between the feed position and the working position. This requires various positioning mechanisms that add to the complexity of the construction of the overall system. If the feed position differs in height from the working position, an extra device is necessary, that is an intermediate table which is vertically slidable in synchronism with the movement of the holding hand.

SUMMARY OF THE INVENTION

The present invention has been accomplished to eliminate these defects of the conventional automatic feeding apparatus. Therefore, one object of the present invention is to provide an automatic feeding apparatus including a swinging mechanism that is driven with a single power motor to cause a hand for holding the workpiece to be repeatedly moved both vertically and horizontally along predetermined paths connecting the feed position and the working position. Another object of the invention is to provide an automatic feeding apparatus that is capable of easily adjusting the amount of the vertical movement of the hand in either the feed position or working position.

PREFERRED EMBODIMENT OF THE INVENTION

One preferred embodiment of the automatic feeding apparatus of the present invention is hereunder described by reference to the accompanying drawings, in which.

Figure 1:
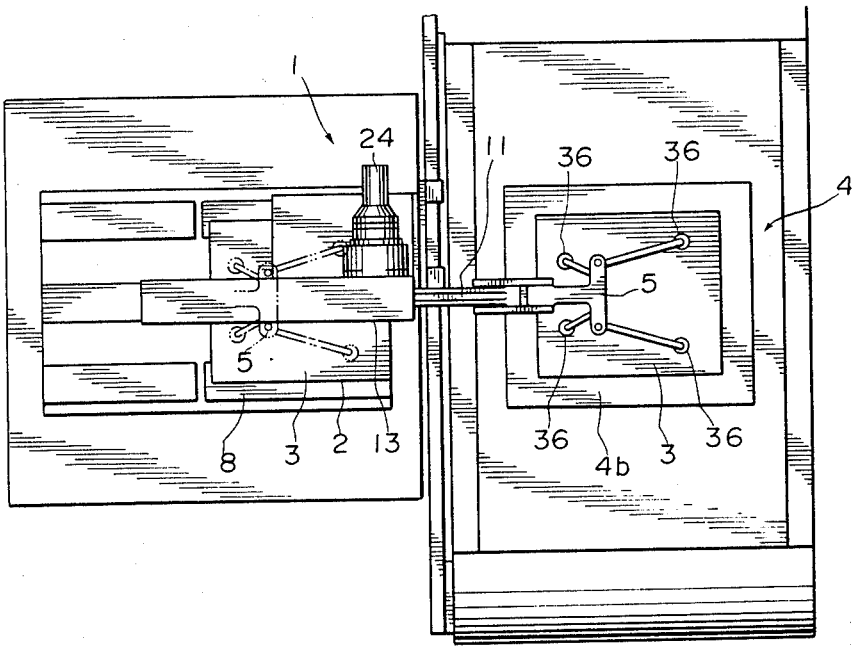
FIG. 1 is a plan view showing one preferred embodiment of the automatic feeding apparatus of the present invention connected to a press.
Figure 2:
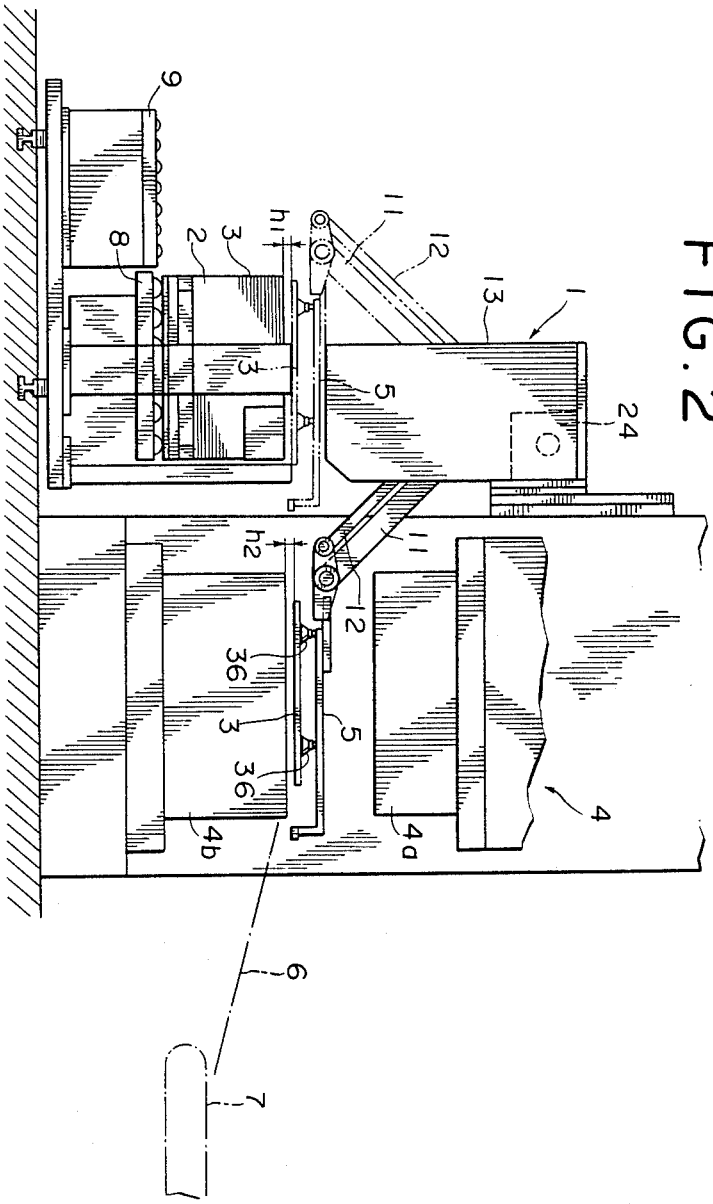
FIG. 2 is a front view of FIG. 1.

In FIGS. 1 and 2, an automatic feeding apparatus generally indicated at 1 is mounted in front of the upper part of a press 4 in a manner slidable both horizontally and vertically. A plurality of workpieces 3 typically in a rectangular sheet form are stacked on a tray 2 in a feed position, and they are automatically and continuously fed to the working position of the press 4 at a predetermined feed rate. The workpiece on the top of the tray is carried by a hand 5 with vacuum suction cups 36 and transferred to between the upper mold 4*a* and lower mold 4*b* of the press, where it is pressed into a predetermined shape. The pressed workpiece is picked up by suitable means (not shown) and forwarded to a conveyor 7 through a chute 6 indicated by the one-long-and-one-short dashed line in FIG. 2. The tray from which all workpieces have been ejected is displaced from a main table 8 on which the tray rests and instead, another tray (not shown) loaded with workpieces is picked up from an adjacent side table 9. To achieve smooth feeding of the workpieces, the position of the workpiece on the top of the tray (feed position) is preferably flush with the position of the top of the lower mold 4*b*, but even if the two positions are different in height, adequately smooth feeding of the workpieces can be accomplished by adjusting the automatic feeding apparatus 1 in the manner which will be described later.

Figure 3:
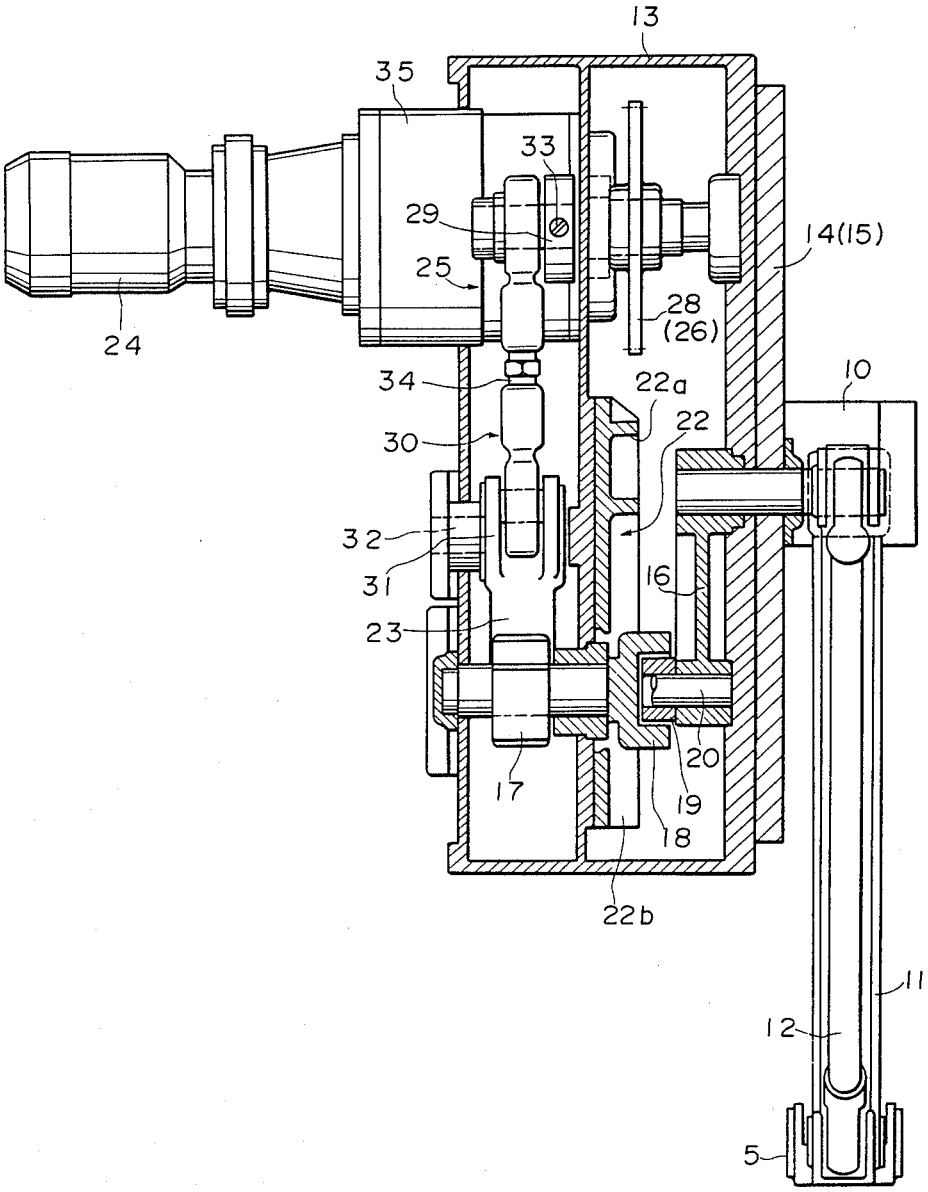
FIG. 3 is a partially cut side view showing the interior of an enlarged essential part of the automatic feeding apparatus according to one preferred embodiment.
Figure 4:
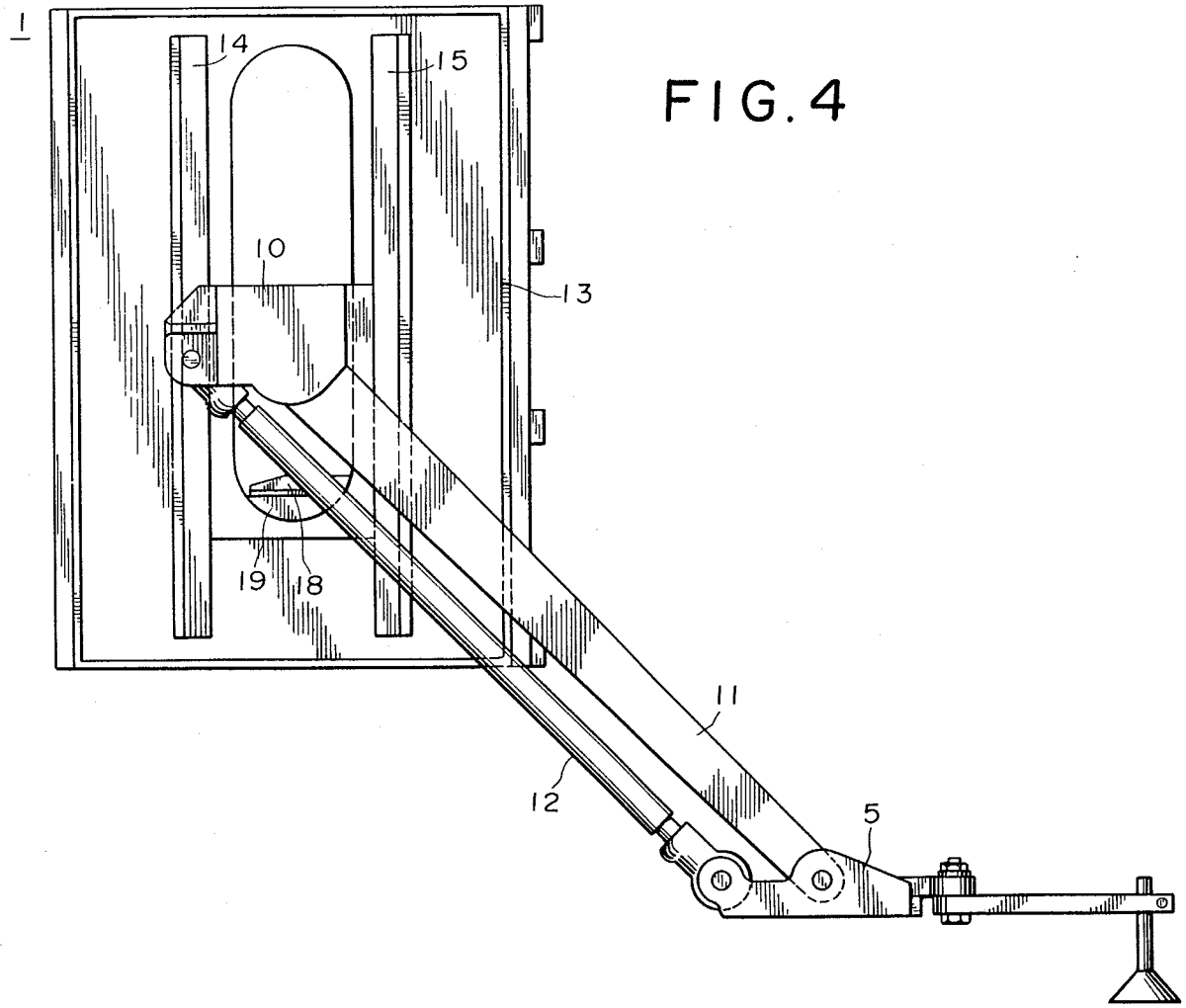
FIG. 4 is a front view of the automatic feeding apparatus of the present invention, with its front cover removed.

The construction and operation of the automatic feeding apparatus 1 of the present invention are described more specifically by reference to FIGS. 3 and 4. The hand 5 with vacuum suction cups 36 is connected to one end of each of two parallel arms 11 and 12 which are pivotally mounted in a bracket 10 at the other end. As the bracket 10 is moved vertically, the hand 5 is moved both vertically and horizontally. The bracket 10 is guided by two rails 14 and 15 with slide bearings that are attached to the frame 13 of the apparatus 1 and which permit the bracket to move only vertically. One end of the bracket 10 is driven vertically with a lever 16 that is pivotally mounted coaxially with the arm 11. The other end of the lever 16 is linked by a shaft 20 to an end of a slider 19 that is slidablv held in a holder 18 with a generally U-shaped cross section which, together with a pinion 17, is attached rotatably to the frame 13. The shaft 20 engages a guide groove 22 with an inverted U-shaped path by means of rollers 21 fitted around the shaft 20. If the holder 18 is rotated by a driving power transmitted from the pinion 17, the slider 19 swings within the holder 18 and changes its direction, whereupon the shaft 20 is moved along a guide groove 22 and the lever 16 causes the bracket 10 to reciprocate vertically. The arm 11 is moved together with the lever 16. The guide groove 22 which generally has an inverted U-shape is fixed within the frame 13 and consists of a curved area 22*a* that permits one end of the arm 11 to move only horizontally and straight areas 22*b* that are provided on both sides of the curved area 22*a* and which permit the ends of the arm 11 to move only vertically. The slider 19 serves as a swinging member and the shaft 20 and rollers 21 make up a guide member.

The pinion 17 is meshed with a sector gear 23 which is swung through an arc of about 90 degrees with a motor 24 having an air clutch brake. The rotating force of the motor 24 is first transmitted from a coaxial sprocket 26 of smaller diameter through a chain 27 to a sprocket 28 of larger diameter. The power is further transmitted to the sector gear 23 through a swinging mechanism 25 including an eccentric plate 29, a freely extendible rod 30 and an arm 31 connected to the lower end of the rod 30. The sector gear 23 is integral with the arm and is pivotally mounted on a pin 32. When the sprocket 28 makes one turn, the air clutch 35 prevents further rotation of the sprocket and the hand 5 rests right above the feed position for the next transport step. The eccentric plate 29 is fixed integrally to the sprocket 28 and holds one end of the rod 30 at a position displaced from the center of the sprocket 28 by a distance of d, which is adjustable according to the amount by which a screw 33 is threaded into the eccentric plate 29. A screw 34 is threaded into the upper member of the rod by a length $l_1$ and the lower member of the rod by a length $l_2$, and the sum of the threaded length (l) can be easily adjusted with a tool like a spanner. The threaded length (l) and the aforementioned distance (d) are two important parameters for determining the swinging characteristics of the swinging mechanism 25.

Figure 5:
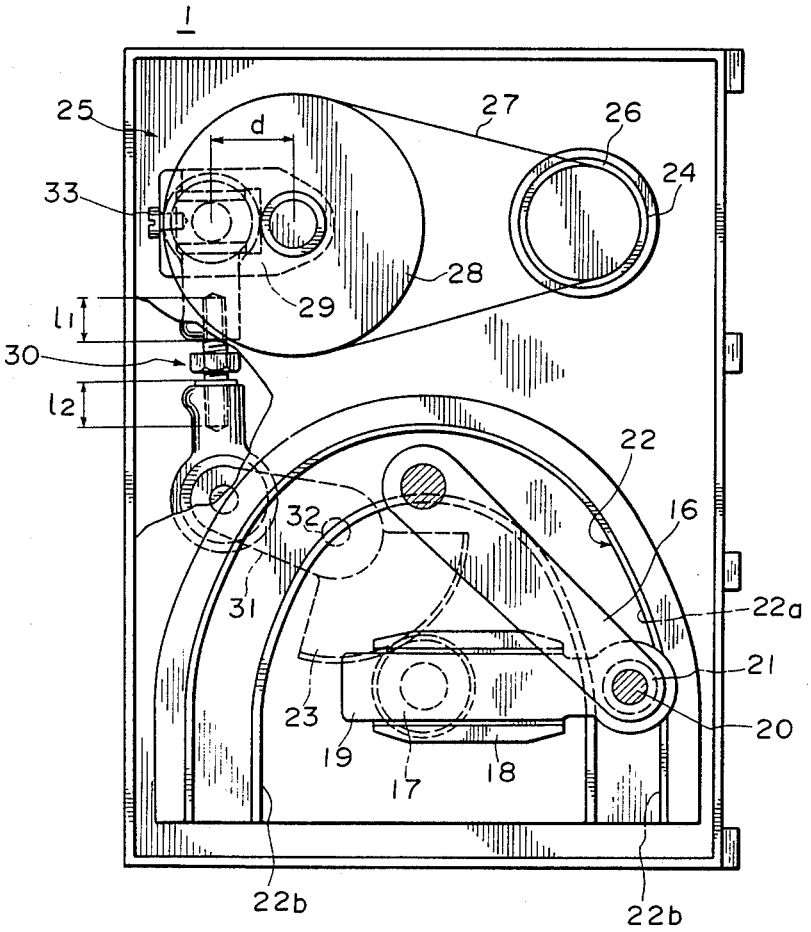
FIG. 5 is a front view showing the interior of an enlarged essential part of the automatic feeding apparatus according to one preferred embodiment.

The operational sequence of the automatic feed apparatus 1 that starts with the position where the hand 5 is right above the working position as shown in FIGS. 1 and 2 is now described. The shaft 20 that is lowered along the curved area 22*a* of the guide groove 20 is then caused to be lowered generally vertically along one of the straight areas 22*b* by the counterclockwise rotation of the sector gear in FIG. 5. In this case, the lever 16 connecting the bracket 10 and shaft 20 is lowered without changing its posture or angle with respect to the horizontal plane of the frame 13, so the hand 5 is lowered down at a right angle with respect to the working position. When the hand is lowered to the working position, the suction that has been applied by cups 36 to the workpiece is released momentarily, and almost at the same time, the sector gear 23 starts to rotate clockwise and the hand 5 disconnected from the workpiece begins to go up. After ascending to the position shown in FIG. 5, the shaft 20 moves along the curved area 22*a* to draw an arc and the lever 16 is shifted gradually from the inclined position to an erect position, and as a result, the bracket 10 moves upward and the hand 5 is moved horizontally while maintaining the height indicated in FIGS. 2 or 4.

When the sector gear 23 has moved to the extreme end of its clockwise rotation, the bracket 10 is at the highest position of its movement and at that time, the hand 5 passes right under the bracket 10. In this case, the eccentric plate 29 is in a position where it has been rotated by nearly 180 degrees from the position indicated in FIG. 5. When the hand 5 has passed right under the bracket 10, the shaft 20 continues to move by inertia along the curved area 22*a* without retrogression. As a result, the hand 5 moves horizontally to right above the feed position but this time following the order reverse to that described above, and then, the air clutch 35 is disconnected from the sector gear 23, and its braking action causes the sprocket 28 to stop rotating, and the hand 5 rests right above the feed position in preparation for the next transport step.

As described in the foregoing, the automatic feed apparatus 1 has the swinging mechanism 25 with the eccentric plate 29 that converts the rotating force of the motor 24 to the swinging motion of the sector gear 23, which drives the slider 19 to be guided by the groove 22 to travel in a predetermined path so as to move the hand 5 both horizontally and vertically. This simple arrangement is sufficient to transfer the workpiece 3 from the feed position to the working position. In particular, the horizontal and vertical movements of the hand can be repeated precisely without any special positioning device but using only the rotating force of the single motor 24, and this leads to a significant reduction in manufacturing and maintenance cost.

In FIG. 2, the amount of vertical movement of the hand in the feed position is indicated by $h_1$ and the corresponding amount in the working position is indicated by $h_2$. The respective values of $h_1$ and $h_2$ and their ratio can be adjusted by simply changing the parameters l and d for the swinging mechanism 25. To increase the values of $h_1$ and $h_2$ without changing their ratio, the threaded length (l) of the screw 34 threaded into the rod 30 may be increased to permit the slider 19 to swing over a wider range of angles. Conversely, the values of $h_1$ and $h_2$ can be decreased by reducing the length (l). To change the ratio of $h_1$ to $h_2$, the screw 33 may be used to decrease the distance (d) between one end of the rod 30 and the center of the sprocket 28 to shift the swinging center of the slider 19 toward the working position, and by so doing, $h_1$ can be reduced with little change in $h_2$. Conversely, by increasing the distance (d), $h_2$ can be decreased with little change in $h_1$. This way, the automatic feed apparatus 1 of the present invention enables simple adjustment of the amount of vertical movement of the hand 5 in both the feed and working positions. Therefore, even if the feed position and the working position cannot be made equal in height due either to dimensional limitations on the tray 2 loaded with workpieces 3 or to the small area of the floor on which the press 4 is to be installed, the apparatus 1 is capable of feeding the workpieces very smoothly.

In the illustrated embodiment, the hand 5 for holding the workpiece 3 is provided with vacuum suction cups 36, but the hand may use other holding devices such as electromagnetic suction cups or chucks, and it is to be understood that the term "holding" has the broad meaning of "holding objects". It is also to be understood that the apparatus of the present invention can be used with machine tools other than the press 4.

As described above, according to the automatic feed apparatus of the present invention, a motor is used as a single power source to drive the swinging mechanism to move the swinging member so as to shift one end of the arm vertically, whereas the other end of the arm is guided by the guide member that is moved along the guide groove in association with the movement of the swinging member, so that said other end of the arm is moved not only horizontally along a path connecting the feed position and working position of the workpiece but also vertically by a predetermined distance in each position. This simple arrangement is sufficient to transfer the workpiece from the feed position to the working position, and furthermore, the apparatus is capable of moving the hand repeatedly along predetermined paths without any special positioning mechanism, and this leads to a great reduction in manufacturing and maintenance cost.

Another advantage of the automatic feed apparatus according to the present invention is that the amount of vertical movement of the hand in both the feed and working positions can be freely controlled by adjusting the range of angles travelled by the swinging member or the center around which it is swung. Therefore, even if the feed position and the working position differ in height, the apparatus is capable of feeding the workpiece smoothly from the feed position to the working position.

As a further advantage, the automatic feed apparatus of the present invention is mountable directly on a press without using a special mounting table, so the apparatus can be installed in a small area. The automatic feed apparatus is mounted in front of the upper part of the press in such a manner that it is movable both horizontally and vertically so it will not hamper mold replacement, repair and inspection jobs.

What is claimed is:

1. An automatic feeding apparatus including an arm for moving a workpiece between a feed position and a working position and having at one end a hand for holding the workpiece and which is pivotally mounted at the other end in a vertically movable manner, a swinging member that is swung by a swinging mechanism driven by a single motor and which is swung to move said other end of the arm vertically and a guide member that is shifted along a guide groove in conjunction with the swinging motion of said swinging member to control the movement of said one end of said arm, said guide groove consisting of a curved area that controls a horizontal movement of said one end of said arm and straight areas that control vertical movements of said one end of said arm at each extremity of said horizontal movement, the swinging action of said swinging member causing the hand to move horizontally between the feed position and the working position of the workpiece and to move vertically by a predetermined distance at each position.

2. An apparatus according to claim 1 wherein said swinging mechanism includes a member to adjust the range of angles by which said swinging member is swung, so as to change the amount of vertical movement of the hand at both said feed position and working position.

3. An apparatus according to claim 1 wherein said swinging mechanism includes a member to adjust the center of the range of angles around which said swinging member is swung, so as to change the ratio of the amount of vertical movement of the hand at said feed position relative to that at said working position.

4. An automatic feeding apparatus including an arm for moving a workpiece between a feed position and a working position and having at one end a hand for holding the workpiece and which is mounted on a bracket for vertical and for pivotal movement, said bracket being guided on rails attached to a frame of said apparatus which permit the bracket to move only vertically, a swinging member that is swung by a swinging mechanism driven by a single motor and which is swung over a range of angles to move said other end of said arm vertically and pivotally, and a guide member that is shifted along a single guide groove in conjunction with the swinging motion of said swinging member to control the movement of said one end of said arm by the vertical and pivotal movement of said other end of said arm, said single guide groove including a curved area that controls a horizontal movement of said one end of said arm and straight areas that control vertical movements of said one end of said arm at each extremity of said horizontal movement, the swinging action of said swinging member causing the hand to move horizontally between the feed position and the working position of the workpiece and to move vertically by a first predetermined distance at the feed position and by a second predetermined distance at the working position.

* * * * *